US007581918B2

(12) United States Patent
Jordan

(10) Patent No.: US 7,581,918 B2
(45) Date of Patent: Sep. 1, 2009

(54) CONE COLLECTING AND LAYING APPARATUS

(76) Inventor: Alan L Jordan, 8 Collinvale, Green Road, Ballyclare, County Antrim (IE) BT39 9PL ( * ) Notice: Subject to any disclaimer, the term of this patent is extended or adjusted under 35 U.S.C. 154(b) by 395 days.

(21) Appl. No.: 11/216,358

(22) Filed: Aug. 31, 2005

(65) Prior Publication Data

US 2006/0054461 A1 Mar. 16, 2006

(30) Foreign Application Priority Data

Aug. 31, 2004 (GB) ..... 0419298.5

(51) Int. Cl.
*B60P 1/00* (2006.01)
*B65G 21/10* (2006.01)
*B65F 1/00* (2006.01)

(52) U.S. Cl. ..... 414/503; 414/523; 414/551; 198/315

(58) Field of Classification Search ..... 414/551, 414/523, 488, 489, 257, 272, 331.09, 351, 414/353, 502, 398, 501, 503, 591, 686, 695.5, 414/695.6, 695.7, 695.8, 703, 718, 749.1, 414/749.6, 589, 695; 198/506, 522, 510.1, 198/602, 315, 316.1, 312, 317, 300, 456.1; 280/456.1

See application file for complete search history.

(56) References Cited

U.S. PATENT DOCUMENTS

| | | | | |
|---|---|---|---|---|
| 2,599,838 A * | 6/1952 | Kandoll | 414/523 |
| 3,174,634 A * | 3/1965 | Peck | 414/541 |
| 3,232,408 A | 2/1966 | Asbury | |
| 3,750,900 A | 8/1973 | Piercey | |
| 3,802,022 A * | 4/1974 | Fleming | 15/84 |
| 3,998,346 A * | 12/1976 | Gibson et al. | 414/666 |
| 4,225,429 A * | 9/1980 | Holley | 209/215 |
| 4,557,657 A * | 12/1985 | Olson et al. | 414/180 |
| 4,597,706 A | 7/1986 | Michit | |
| 5,036,791 A | 8/1991 | Thurston | |
| 5,244,334 A * | 9/1993 | Akita et al. | 414/502 |
| 5,618,146 A * | 4/1997 | Cooper | 414/24.5 |

FOREIGN PATENT DOCUMENTS

| | | |
|---|---|---|
| GB | 2 175 336 A | 11/1986 |
| GB | 2 240 126 A | 7/1991 |
| GB | 2 268 772 A | 1/1994 |
| GB | 2 301 131 A | 11/1996 |

(Continued)

OTHER PUBLICATIONS

Search Report dated Dec. 8, 2005 in connection with European Patent Application No. 05076998.3, which corresponds to the present application.

*Primary Examiner*—Gregory W Adams
(74) *Attorney, Agent, or Firm*—Van Dyke, Gardner, Linn & Burkhart, LLP

(57) ABSTRACT

An apparatus for collecting traffic cones from a surface to a vehicle, or dispensing traffic cones onto the surface from the vehicle, includes a conveyor disposed in use between the vehicle and the surface for transferring cones therebetween. The apparatus further includes means for actuating the conveyor in a transverse direction substantially perpendicular with the direction of movement of the vehicle during use. This allows the apparatus to lift and lay cone tapers.

22 Claims, 10 Drawing Sheets

FOREIGN PATENT DOCUMENTS

| | | | |
|---|---|---|---|
| GB | 2 309 244 | A | 7/1997 |
| GB | 2 325 683 | A | 12/1998 |
| JP | 61108021 | | 5/1986 |
| WO | WO 94/16150 | | 7/1994 |
| WO | WO 03/102309 | A1 | 12/2003 |

* cited by examiner

CONE COLLECTING AND LAYING APPARATUS

TECHNICAL FIELD AND BACKGROUND OF THE INVENTION

The present invention relates to an apparatus for collecting and laying items, especially road traffic items such as traffic cones.

In today's fast moving world the motoring public demands ever greater quality from our road networks, in addition to improved standards of safety. This requires continued maintenance of our roadways to ensure the structural integrity of same, as well as the improvement of existing, or retro fitting of new, safety measures. As a result, the use of temporary road management systems has become an integral part of our road management techniques, and in particular the use of traffic cones, which are often used in significant numbers. For example, if a safety barrier is to be fitted along the central reservation of a carriageway, it is usually necessary to cordon off the central reservation using traffic cones, which may need to be deployed in large numbers and possibly over several kilometers at any given time.

The deployment and collection of such a large number of traffic cones is a time consuming and physically demanding task. In order to simplify this process, a cone dispensing/collecting apparatus may be employed, for example of the type shown in the applicant's earlier UK Pat. No. GB2325683, the details of which are incorporated herein by reference. The apparatus of GB2325683 removes the need for workers to be on the road while traffic cones are being laid or collected. This is particularly important on high speed roads and motorways. The cone dispensing/collecting apparatus of GB2325683 suffers from a number of drawbacks. In particular, the setting out and taking down of a "cone taper", a term commonly used within the industry to define the tapered off area commonly used at the start of a road closure, can prove difficult to achieve with the apparatus of GB2325683. In addition, the apparatus of GB2325683 cannot reliably be used to collect traffic cones having any form of attachment secured to or adjacent the top thereof, for example a beacon or road sign.

SUMMARY OF THE INVENTION

A first aspect of the present invention provides an apparatus for collecting traffic cones from a surface to a vehicle, or dispensing traffic cones onto the surface from the vehicle. The apparatus includes a conveyor disposed in use between the vehicle and the surface for transferring cones therebetween, wherein the apparatus further includes means for actuating the conveyor in a transverse direction substantially perpendicular with the direction of movement of the vehicle during use.

The conveyor actuating means may include a sliding mechanism for effecting relative sliding movement between the conveyor and the vehicle in the transverse direction. The sliding mechanism may include a base section mountable on the vehicle and a sliding section slidably coupled to the base section for sliding movement in the transverse direction, and means for effecting relative sliding movement between the base section and the sliding section. The conveyor is coupled to the sliding section. Preferably, the sliding section is telescopically coupled to the base section such that at least a portion of the sliding section may slide beyond one or both ends of the base section in the transverse direction.

The conveyor is preferably coupled to the sliding mechanism by means of a carriage. The carriage is slidable with respect to the sliding section in the transverse direction. The carriage may be coupled to the sliding section such that sliding movement of the sliding section causes a corresponding sliding movement of the carriage in the same direction.

Advantageously, the apparatus further includes means for controlling the speed at which the conveyor actuating means actuates the conveyor. The controlling means is arranged to set the actuation speed of the conveyor depending on the speed of the vehicle.

In preferred embodiments, the apparatus further includes a transfer mechanism for transferring traffic cones from the surface to the conveyor. The transfer mechanism includes a toppling device arranged to engage with and tilt a cone as the apparatus is advanced towards the cone, and to release the cone as the apparatus is further advanced towards the cone such that the cone returns to an upright position under the action of gravity.

The toppling device may include at least one contact member connected to or including at least one toppling member. The at least one contact member is movable between a rest state, in which the at least one toppling member is positioned to engage with and tilt a cone, and a displaced state, in which the at least one toppling member is displaced from the engage and tilt position. The arrangement is such that, when the at least one toppling member engages with and tilts a cone, the tilted cone engages with the at least one contact member and moves the contact member from the rest state to the displaced state. The at least one contact member is advantageously pivotable with respect to the transfer mechanism. Preferably, the at least one contact member is positioned in the rest state for engagement with the base of a tilted cone. In a preferred embodiment, two contact members are provided, each associated with a respective toppling member and being located on opposing sides of the transfer mechanism.

Alternatively, the toppling device may include a toppling member that is movable between a rest state, in which the toppling member is positioned for engagement with a cone, and a displaced state, in which the toppling member is moved generally away from the conveyor with respect to the rest state. The arrangement is such that, when a cone is dispensed from the conveyor and as the apparatus retreats from the cone, the cone engages with the toppling member and moves it to the displaced state. The toppling device may include at least one stop member for preventing the toppling member from being moved towards the conveyor with respect to the rest state. For example, the toppling device may include a support frame carried by the transfer mechanism. The toppling bar may be pivotably mounted on the support frame for swinging movement between the rest and displaced states.

The transfer mechanism advantageously includes, or is associated with, means for guiding a cone to the conveyor as the apparatus advances towards the cone. The guide means defines a channel having a relatively wide mouth distal the conveyor and becoming narrower in a direction towards the conveyor. Preferably, the channel includes a relatively narrow portion between the mouth and the conveyor which is substantially aligned with the center of the conveyor.

In a preferred embodiment, in a portion of the channel, the guide means is arranged to engage with a tilted cone in order to limit the extent to which the cone can tilt. The guide means may include a respective guide member or rail located at either side of the transfer mechanism and being shaped and dimensioned to define the channel. Preferably, the toppling device is located between the mouth of the channel and the conveyor. Advantageously, the guide means is located adjacent the surface at the mouth of the channel and rises in a direction towards the conveyor.

Preferably, the carriage is adapted to enable the angular inclination of the conveyor with respect to the surface to be varied.

Preferably, the conveyor is mounted to the carriage via an articulated arm which is capable of raising the conveyor into a retracted position for storage/transport. Preferably, the apparatus includes at least one actuator operable to raise and lower the articulated arm.

The conveyor may include retaining or guide rails arranged in spaced relation to a conveying surface of the conveyor, in order to prevent toppling of the cone by engaging the base of the cone while on the conveyor and/or by limiting the degree by which a cone can tilt when on the conveyor.

In preferred embodiments, the apparatus includes a secondary conveyor disposed, in use, between the vehicle and the upper end of the conveyor. The secondary conveyor is preferably coupled to the sliding mechanism and/or the conveyor, so as to fix the position of the secondary conveyor relative to the conveyor. Preferably, the apparatus includes at least one guide rail associated with the secondary conveyor for guiding cones from the secondary conveyor onto the vehicle. The guide rail(s) are preferably pivotable with respect to the secondary conveyor about an in use substantially vertical axis.

A second aspect of the invention provides an apparatus for collecting traffic cones from a surface to a vehicle, or dispensing traffic cones onto the surface from the vehicle. The apparatus includes a conveyor disposed in use between the vehicle and the surface for transferring cones therebetween, and a transfer mechanism for transferring traffic cones from the surface to the conveyor. The transfer mechanism includes a toppling device arranged to engage with and tilt a cone as the apparatus is advanced towards the cone, and to release the cone as the apparatus is further advanced towards the cone such that the cone returns to an upright position under the action of gravity. Wherein the toppling device includes at least one contact member connected to or including at least one toppling member. The at least one contact member is movable between a rest state, in which the at least one toppling member is positioned to engage with and tilt a cone, and a displaced state, in which the at least one toppling member is displaced from the engage and tilt position. The arrangement is such that, when the at least one toppling member engages with and tilts a cone, the tilted cone engages with the at least one contact member and moves the contact member from the rest state to the displaced state.

A third aspect of the invention provides an apparatus for collecting traffic cones from a surface to a vehicle, or dispensing traffic cones onto the surface from the vehicle. The apparatus includes a conveyor disposed in use between the vehicle and the surface for transferring cones therebetween, and a transfer mechanism for transferring traffic cones from the surface to the conveyor. The transfer mechanism includes a toppling device arranged to engage with and tilt a cone as the apparatus is advanced towards the cone, and to release the cone as the apparatus is further advanced towards the cone, such that the cone returns to an upright position under the action of gravity. Wherein the toppling device includes a toppling member that is movable between a rest state, in which the toppling member is positioned for engagement with a cone, and a displaced state, in which the toppling member is moved generally away from the conveyor with respect to the rest state. The arrangement is such that, when a cone is dispensed from the conveyor and as the apparatus retreats from the cone, the cone engages with the toppling member and moves it to the displaced state.

A fourth aspect of the invention provides an apparatus for collecting traffic cones from a surface to a vehicle, or dispensing traffic cones onto the surface from the vehicle. The apparatus includes a conveyor disposed in use between the vehicle and the surface for transferring cones therebetween, and a transfer mechanism for transferring traffic cones from the surface to the conveyor. Wherein the transfer mechanism includes, or is associated with, means for guiding a cone to the conveyor as the apparatus advances towards the cone. The guide means defines a channel having a relatively wide mouth distal the conveyor and becoming narrower in a direction towards the conveyor.

From a further aspect, the invention also provides a vehicle to which an apparatus of the other aspects of the invention is mounted.

Further advantageous aspects, objects, advantages, purposes and features of the invention will become apparent to those ordinarily skilled in the art upon review of the following description taken in conjunction with the accompanying drawings.

BRIEF DESCRIPTION OF THE DRAWINGS

An embodiment of the invention is now be described by way of example and with reference to the accompanying drawings, in which like numerals are used to indicate like parts and in which.

DETAILED DESCRIPTION OF THE DRAWINGS

Figure 1:
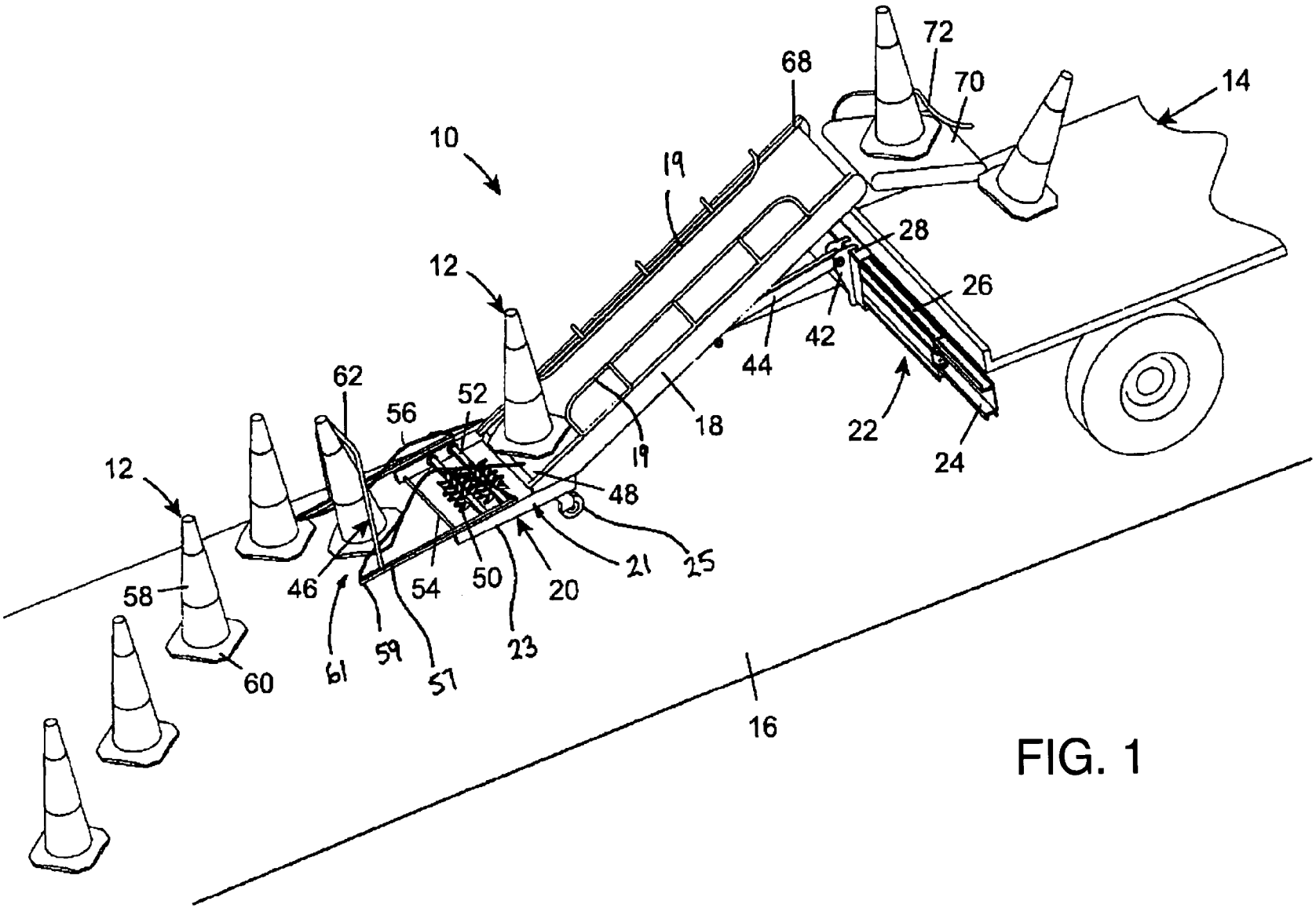
FIG. 1 is a perspective view of a cone dispensing/collecting apparatus embodying at least one aspect of the present invention, the apparatus being shown in use on a road.

Referring now to FIG. 1 of the accompanying drawings, there is illustrated a cone collecting apparatus, generally indicated as 10, for collecting, or lifting road or traffic cones 12 from a roadway 16 or other surface, and for depositing, or laying, traffic cones 12 from a vehicle 14 onto a roadway 16 or other surface. The term "traffic cone" as used herein is intended to embrace any object that may require to be lifted and laid on a surface, especially a road surface, and especially for the purpose of traffic direction or road marking. Such objects need not necessarily be cone-shaped. In general, the objects may be referred to as free-standing markers or pylons.

In preferred embodiments, the apparatus 10 is connectable to the vehicle 14 at the rear of the vehicle 14 (as illustrated in FIG. 1). When so connected, the conveyor 18 (or at least a main portion thereof) is preferably disposed substantially parallel with the direction of movement of the vehicle 16 during use, i.e. substantially parallel with the longitudinal axis of the vehicle 14. Typically, the vehicle 14 has a flat bed storage area, or other storage area, from which cones 12 may be loaded onto the conveyor 18, and onto which cones 12 may be loaded from the conveyor 18. In this preferred configuration, when cones 12 are being dispensed, the vehicle 14 drives forward, and when cones 12 are being lifted, the vehicle 14 reverses towards the cones 12. During use, the vehicle 14 normally travels in a substantially straight line, although some left or right (lateral) adjustment may be required to maintain alignment with the cones 12 to be lifted or with the target area for dispensing cones, and may also negotiate bends in the road.

The apparatus 10 includes a conveyor 18, for example an endless belt type conveyor, which, during use, extends between the vehicle 14 and the road 16. A transfer mechanism 20 is provided adjacent the, in use, road end of the conveyor 18 and facilitates the lifting of cones 12 onto the conveyor 18, or the depositing of cones 12 from the conveyor 18 onto the road 16, depending on the mode of operation of the apparatus 10. The configuration and operation of the conveyor 18 and transfer mechanism, or transfer means, 20 may for example be the same as the arrangement described in the applicant's earlier UK Patent GB2325683, as will be described in more detail hereinafter.

Unlike the apparatus of GB2325683, the apparatus 10 includes means for actuating the apparatus laterally with respect to the vehicle 14. The preferred actuating means takes the form of a sliding mechanism, or slideway 22, for coupling the apparatus 10 to the vehicle 14. The slideway 22 is arranged to effect movement of the apparatus 10, and in particular movement of the conveyor 18, in a lateral or transverse direction that is substantially perpendicular to the direction of movement of the vehicle 14 as cones 12 are being deposited or collected, i.e. normally in a direction substantially perpendicular with the longitudinal axis of the vehicle (hereinafter referred to as the "transverse" direction). In the preferred embodiment, the slideway 22 is arranged to effect movement of the apparatus 10, and in particular movement of the conveyor 18, in a direction that is substantially perpendicular to the direction in which cones 12 travel along the conveyor 18 during use.

The conveyor 18 is preferably provided with a guide, in the preferred form of a rail 19, extending along each side of the conveyor, preferably substantially along the full length of the conveyor 18, to help maintain cones 12 on the conveyor during use. The spacing between the guide rails 19 is advantageously less than the width of the base of the cones 12, in order to prevent the cones from toppling when on the conveyor 18. Part of the guide rails 19 are preferably located over but spaced from the surface of the conveyor 18 to allow the base of the cones to pass beneath the rails 19 but to limit the degree to which the cones 12 may tilt as they travel up the conveyor 18. Preferably, the arrangement is such that the cones 12 are prevented from tilting beyond a point where their center of gravity no longer returns them to the upright position. The guides 19 are advantageously positioned to align the cones 12 with the secondary conveyor 70 (when collecting cones 12) or with the transfer mechanism 20 (when laying cones 12). In the preferred embodiment, the main conveyor 18, secondary conveyor 70 and transfer mechanism 20 have a substantially common longitudinal axis, the guides 19 being arranged to align the cones 12 with said longitudinal axis.

In a preferred embodiment, a gate (not shown) is provided at the in use lower end 48 of the conveyor 18. The gate is actuatable between an open state, in which it allows cones 12 to be transferred between the conveyor 18 and the transfer mechanism 20, and a closed state, in which it prevents cones 12 from being transferred between the transfer mechanism 20 and the conveyor 18. The gate may, for example, take the form of a bar, plate or other gate member and may for example by pivotably or slidably mounted on the frame 21, or elsewhere on the apparatus 10, for pivoting or sliding movement between the open and closed states. The gate is preferably in operative association with actuating means, for example in the form of a hydraulic, pneumatic or electrical ram or actuator for actuating the gate between the open and closed states. The actuating means is advantageously controlled by a control unit which may, for example, include a programmable logic controller (PLC). In use, the gate may be closed and opened in order to control or regulate the dispensing of cones 12 from the conveyor 18 onto the transfer mechanism 20. For example, the gate may open (and then close) at regular (or irregular) intervals in order to determine the spacing between successive dispensed cones 12. This may cause a queue of cones 12 to build up on the conveyor 18. By controlling the dispensing of cones 12 in the manner (especially by means of an automated control unit), the operation of the apparatus 10 is less reliant on the ability of a person (not shown) to load cones 12 onto the conveyor 18 appropriately during the dispensing operation.

In a preferred embodiment, one or more guide members (not shown) may be associated with the conveying part of the transfer mechanism 20 (shown as drums 50 in FIG. 1) in order to prevent or limit the misalignment or jostling of cones 12 as they pass over the conveying part of the transfer mechanism 20. The guide member(s) may take the form of one or more rails disposed above (during use) the conveying part and running substantially parallel with the longitudinal axis of the conveyor 18 and transfer mechanism 20, i.e. the direction in which cones are conveyed during use. The guide rail(s) are preferably arranged to engage with the base of a cone 12 as it passes over said conveying part in order to prevent or limit twisting or swiveling movement of the cone 12 about an in use vertical axis.

It is further preferred to provide one or more abutments (not shown) for aligning cones 12 that are misaligned as they travel along the conveyor 18 to be dispensed, and/or pass through the transfer mechanism to be dispensed. For example, one or more abutments may be associated with the conveyor 18 and positioned to engage with a misaligned cone 12 on the conveyor such that the relative movement between the misaligned cone 12 and the abutment(s) causes the cone 12 to pivot or swivel (about an axis substantially perpendicular with the conveying surface) thereby improving the alignment of the cone 12. Conveniently, such abutments are positioned to engage with the base of misaligned cones. This is because the geometry of the base of a typical cone causes it to be wider in a direction transverse of the conveyor 18 if it is misaligned compared to its width when aligned. So, one or more abutments may be located adjacent the conveying surface of the conveyor 18 at a position displaced laterally from the longitudinal axis of the conveyor 18 such that they engage with the base of cones 12 that are misaligned but not with cones 12 that are correctly aligned. One or more similar abutments may be provided elsewhere on the apparatus 10, for example at or adjacent the mouth 61 of the transfer mechanism 20.

Figure 2:
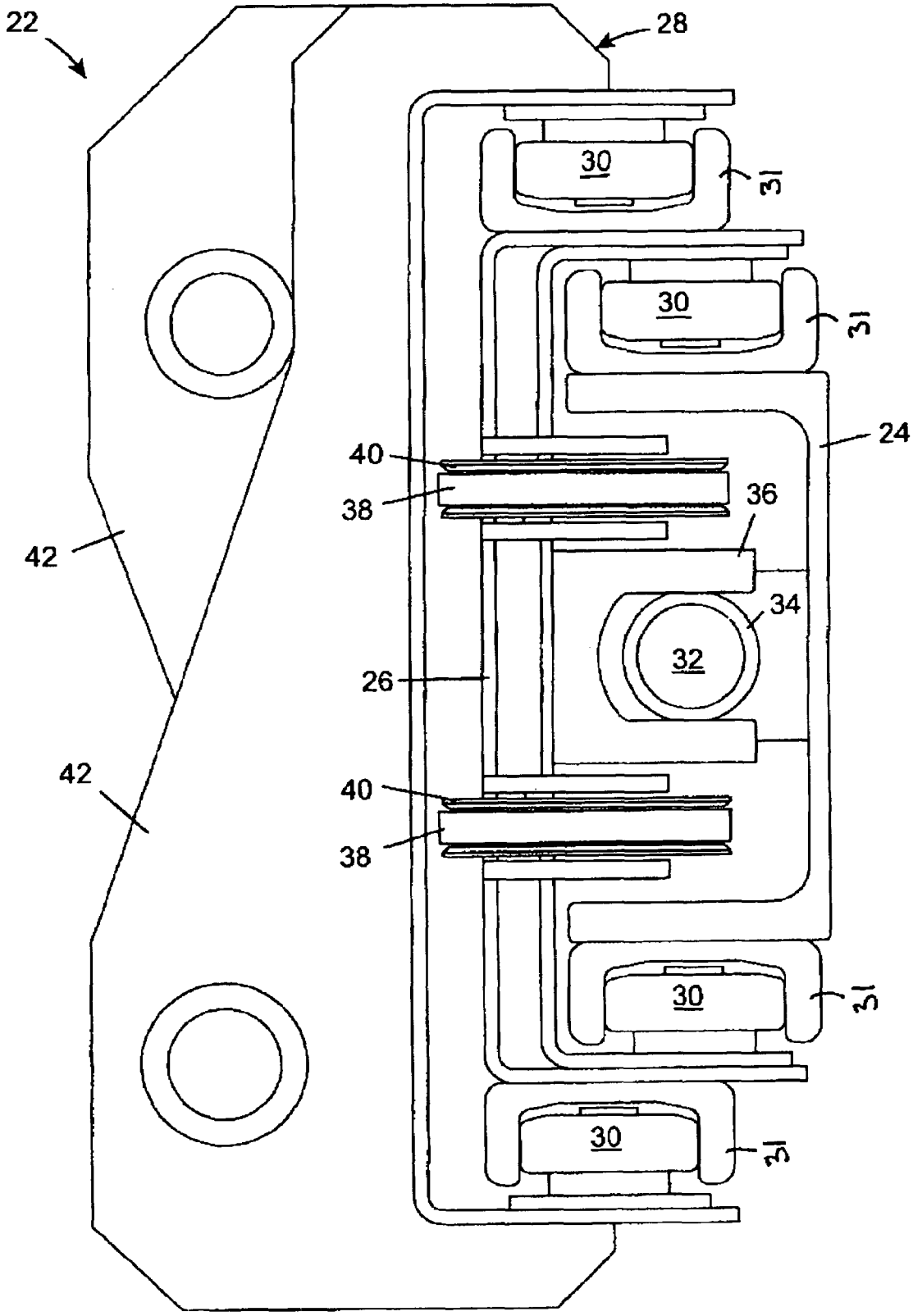
FIG. 2 is an end view of a slideway that forms part of the apparatus illustrated in FIG. 1.
Figure 3:
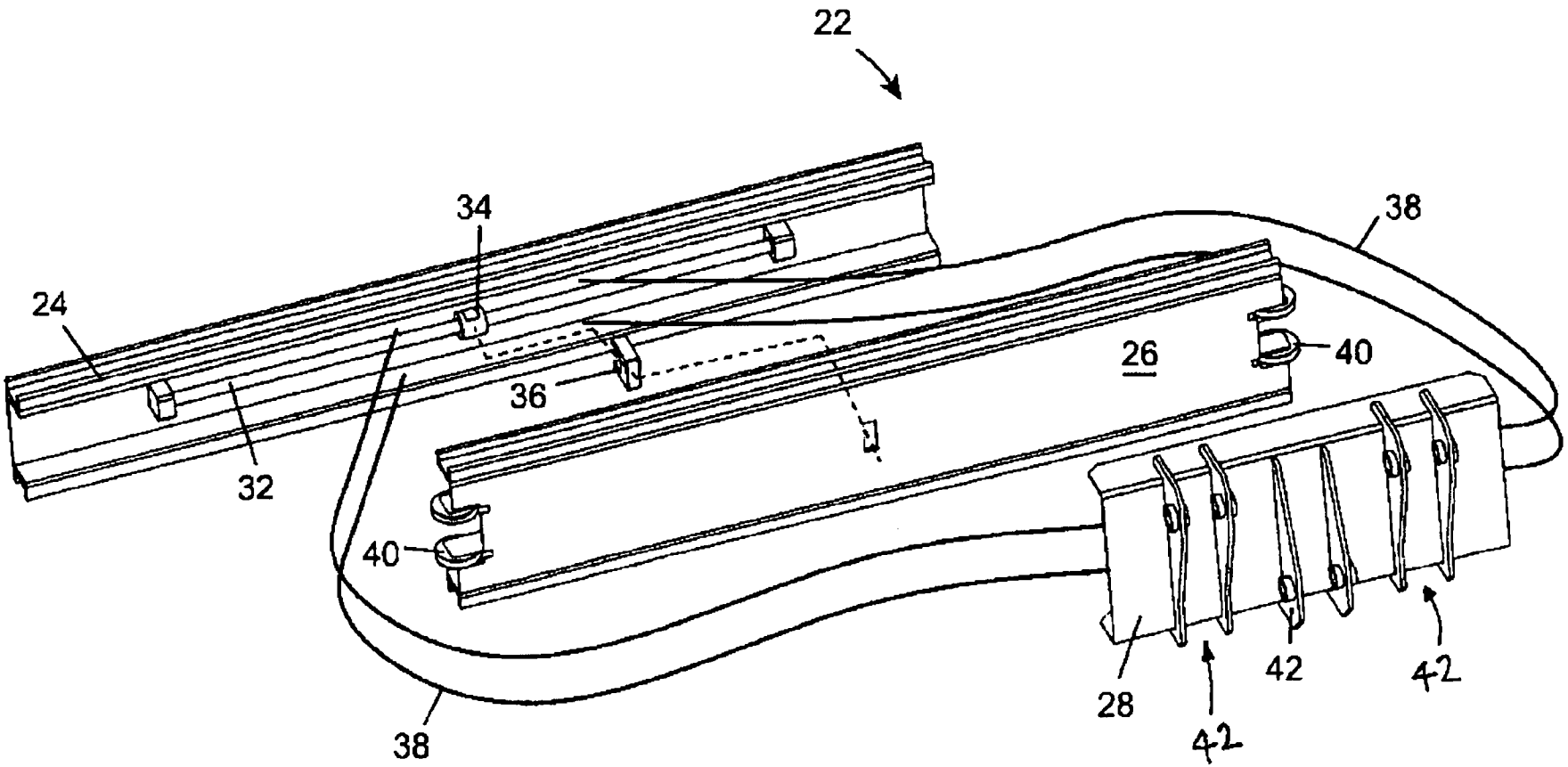
FIG. 3 is an exploded perspective view of the slideway illustrated in FIG. 2.

Referring in particular to FIGS. 2 and 3, the preferred slideway 22 includes a first rail 24, or base section, for mounting to the vehicle 14, conveniently at a rear thereof as illustrated in FIG. 1, and a second rail 26, or slide, slidable with respect to the first rail 24 in the transverse direction. The preferred slideway 22 further includes a carriage 28 slidable with respect to the second rail 26 in the transverse direction. The carriage 28 is connected to the conveyor 18, as may best be viewed in FIG. 1 so that the conveyor 18 moves with the carriage 28 in the transverse direction. In the illustrated embodiment, the second rail 26 is slidably mounted on the first rail 24, while the carriage 28 is slidably mounted on the second rail 26. To this end, the second rail 26 and the carriage 28 are advantageously each provided with a respective set of one or more rollers 30 in order to facilitate the relative sliding movement with the first rail 24 and the second rail 26 respectively. The first rail 24 and the second rail 26 are each provided with one or more corresponding roller guides 31, or runners, for receiving the rollers 30. In alternative embodiments (not illustrated), the rollers 30 can be replaced with any other suitable bearing (not shown) capable of providing a sliding fit, or sliding movement, between the first rail 24 and the second rail 26, and between the second rail 26 and the carriage 28. The slideway 22 allows lateral displacement, in the transverse direction, of the second rail 26 relative to the first rail 24, and of the carriage 28 relative to the second rail 26. The preferred slideway 22 is telescopic in the transverse direction. In the preferred embodiment, the second rail 26 is telescopically mounted on, or coupled to, the first rail 24 so that it may extend beyond the first rail in at least one, and preferably both, the left and right directions. Hence, in extreme left hand side and/or right hand side positions (as viewed for example in FIG. 1) the second rail 26 may protrude beyond the vehicle 14 in the transverse direction. In the illustrated embodiment, the carriage 28 does not project beyond the second rail in the transverse direction but may be moved left and right along substantially the entire length of the second rail 26 in the transverse direction. In alternative embodiments, the carriage 28 may be telescopic with respect to the second rail 26, i.e. may project beyond the second rail transversely in one or both directions. In such arrangements, the second rail 26 may, or may not, be telescopic with respect to the first rail, or base 24. In any event it is preferred that at least one of the sliding components of the slideway 22 is telescopic (left and/or right) with respect to the base section.

The slideway 22 further includes an actuating mechanism, conveniently in the form of a lead screw 32, for effecting relative movement between the rails 24, 26. In the illustrated embodiment, the lead screw 32 is provided on the first rail 24 and carries a follower 34 (e.g. in the form of a lead screw nut) which is connected or coupled to the second rail 26 via a coupling device in the form of a projection or bracket 36. Rotation of the lead screw 32 causes movement of the follower 34, and therefore of bracket 36, in the transverse direction and so effects lateral displacement of the second rail 26 with respect to the first rail 24 (as a result of the coupling between the bracket 36 and the second rail 26), the direction of transverse displacement (i.e. left or right) of the second rail 26 being dependent on the direction of rotation of the lead screw 32. The lead screw 32 and follower 34 may be replaced by any other suitable mechanism, for example a fluid powered ram (not shown).

In the preferred embodiment, in order to effect the displacement of the carriage 28 with respect to the second rail 26, the slideway 22 is coupled to the first and second rails 24, 26 by means of a belt device comprising at least one length of flexible, substantially inelastic line or chain, the chains(s) being fixed to the carriage 28 and to the first rail 24 while being in sliding or rolling contact with the second rail 26. The arrangement is such that movement of the second rail 26 left or right causes a corresponding left or right movement of the carriage 28 by the action of the second rail 28 on the chains(s) and, in turn, by the chain(s) on the carriage 28. In the preferred embodiment, the belt device includes four lengths of chain, or other line 38, each having one end fixed to the first rail 24 and the other end fixed to the carriage 28. The chains 38 each pass around and engage with an end (two chains per end as shown in FIG. 3) of the second rail 26, preferably via a respective guide wheel 40 provided at the ends of the second rail 26. Thus as the second rail 26 is laterally or transversely displaced, the fixed nature of the chains 38 results in the carriage 28 being drawn along the second rail 26 in the direction of displacement of same. In the preferred embodiment, the carriage 28 is able to travel across the entire length of the second rail 26 in the transverse direction. The chains 38 and guide wheels 40 may be replaced by any other suitable actuating mechanism, for example a pneumatic or hydraulic ram (not shown).

Advantageously, the apparatus 10 includes a control unit (not shown)—which may for example include a PLC (programmable logic controller) device—that monitors the speed of the vehicle 14, by any suitable conventional means, and sets the speed at which the conveyor 18 is moved in the transverse direction. In the illustrated embodiment, this corresponds to the speed at which the second rail 26 is actuated which, in turn, is determined by the speed of rotation of the lead screw 32. The lead screw may be actuated by any suitable drive means (not shown), e.g. a motor, under the control of the control unit. The speed of transverse movement of the conveyor 18, in conjunction with the speed of movement of the vehicle 14, is set to allow certain cone configurations, especially tapers, to be lifted or laid.

In the preferred embodiment, the carriage 28 is connected to the conveyor 18 by means of an arm 44 (FIG. 1). For example, one end of the arm is connected to a set of lugs 42, the other end of the arm 44 being connected to the underside of the conveyor 18. During use, the slideway 22 enables the apparatus 10, and in particular the conveyor 18, to be displaced laterally or transversely with respect to the vehicle 14. As the vehicle 14 traverses the road 16, dispensing or collecting cones 12, the conveyor 18 may be displaced from left to right, or vice versa, in order to enable the setting out of a cone taper, as illustrated in FIG. 1, or other cone configuration. In addition, by positioning the apparatus 10 at or beyond the left or right hand sides of the vehicle 14, the apparatus 10 may lift or lay cones 12 between traffic lanes while the vehicle 14 itself remains within one traffic lane or off the road (e.g. on a hard shoulder).

The apparatus 10 or the vehicle 14 may be fitted with sensors (not shown) mounted on one or both sides of the apparatus 10 or vehicle 14 for detecting the proximity of road markings, such as the white line (not shown) marking dual or multi-lanes of a modern highway or road 16. When such a marking is detected, the slideway 22 may be automatically actuated in order to displace the apparatus 10 towards the center of the vehicle 14 in order to avoid the apparatus 10 crossing into the path of a vehicle (not shown) in an adjacent traffic lane (not shown).

Figure 7:
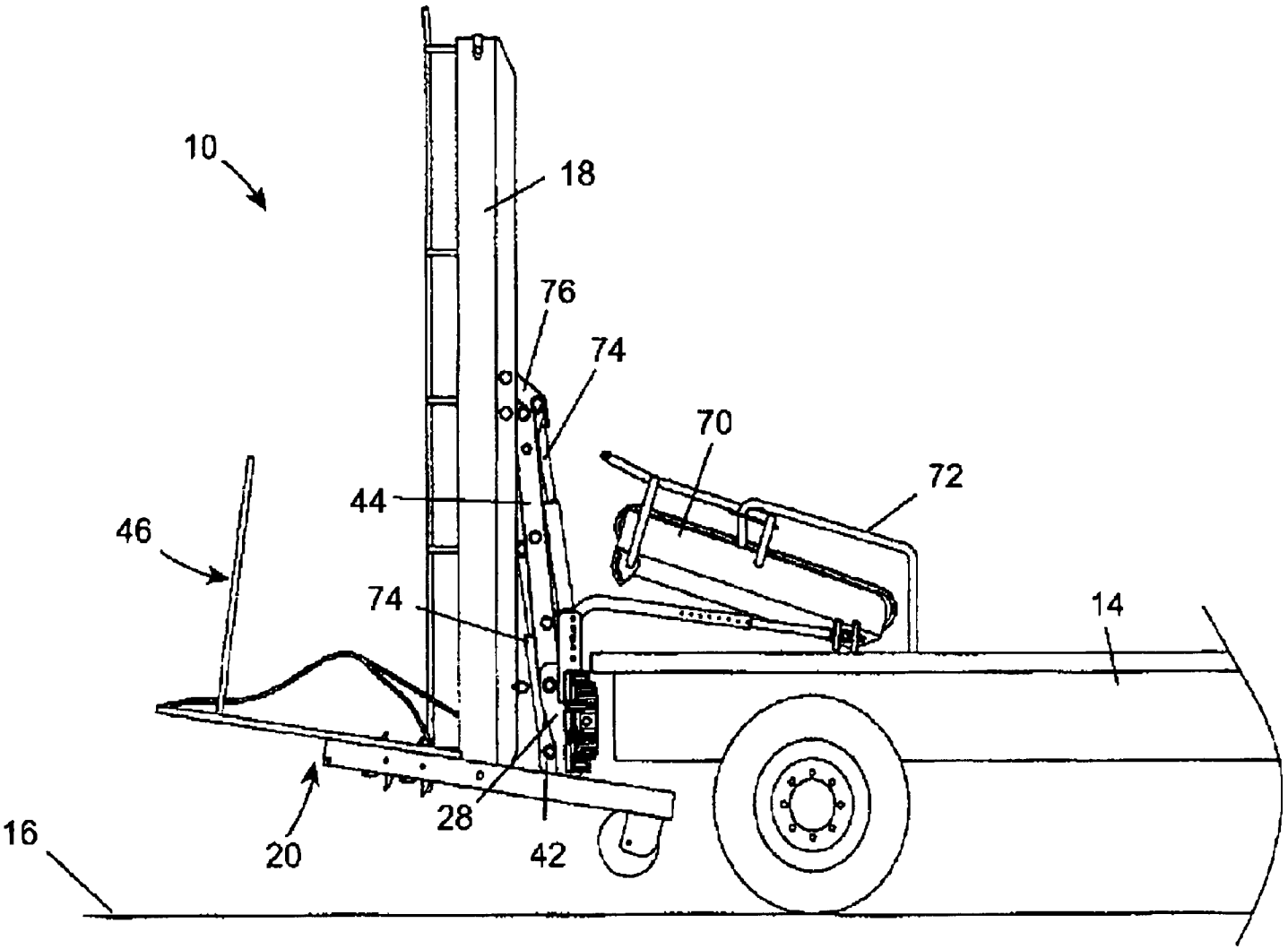
FIG. 7 illustrates the apparatus of FIG. 1 in a stored position.

Referring now to FIG. 7, in addition to allowing the apparatus 10 to be displaced laterally with respect to the vehicle 14, the carriage 28 preferably provides a further function. The arm 44 securing the conveyor 18 to the carriage 28 is articulated, being pivotable with respect to both the carriage 28 and the conveyor 18, and can therefore be raised upwardly from the position illustrated in FIG. 1, in order to raise the conveyor 18 into a storage position as illustrated in FIG. 7. The apparatus 10 preferably includes at least one actuator for moving the conveyor 18 between the use and storage states. In the embodiment illustrated, two actuators in the form of a of hydraulic rams 74 are provided, one having one end connected to a set of lugs 42 provided on the carriage 28, and the other end connected to the arm 44, and the other mounted to the apparatus adjacent (above as shown in FIG. 7) the carriage 28 at one end, and to a conventional linkage, e.g. a four bar linkage 76, at the other end, connecting the upper (as viewed in FIG. 7) hydraulic ram 74 to the arm 44. Starting from the use state of FIG. 1, extension of the lower (as viewed in FIG. 7) hydraulic ram 74, in combination with extension of the upper hydraulic ram 74, raises the arm 44 upwardly. As the arm 44 is raised upwardly, the weight of the conveyor 18 and transfer mechanism 20, in addition to the action of the linkage 76, causes the conveyor 18 to rotate (anti-clockwise as viewed in FIG. 7) about the arm 44, towards a substantially vertical position. The final storage position of the apparatus 10 is preferably one in which the arm 44 is extended substantially vertically upwards, with the conveyor 18 disposed generally parallel to the arm 44, also in a substantially vertical position, as illustrated. The arm 44 and conveyor 18 are suitably dimensioned such that, in this storage position, the entire apparatus 10, and in particular the transfer mechanism 20, is raised off the road 16. To assist in this operation, the transfer mechanism 20 is preferably pivotable with respect to the conveyor 18. When the apparatus 10 is not in use, it may be raised into the storage position shown in FIG. 7, wherein the vehicle 14 can be driven as normal. The apparatus 10 can readily be deployed for use by retracting the rams 74. The arm 44 and associated actuators also allow the angular disposition of the conveyor 18 with respect to the road 16 to be adjusted. In the preferred embodiment, the angle of the conveyor 18 relative to the road surface 16 is increased with respect to the apparatus of GB 2325683 and this reduces the length of conveyor 18 required. The preferred angle of inclination is between approximately 15 and 45 degrees. The angle of inclination may be varied to suit different types of vehicle 14 having rear sections at different heights. In a preferred embodiment, only a single actuator is used to actuate the apparatus 10 between the use and storage states. The actuator is pivotably mounted between the frame 21 and the conveyor 18 in a manner similar to that of the lower ram 74 shown in FIG. 7. The upper ram 74 and linkage 76 may be replaced by a linkage, e.g. a four point linkage, extending between the conveyor 18 and the base of the slideway.

In addition to the slideway 22, the apparatus 10 is advantageously provided with a modified transfer mechanism 20. As with the apparatus of GB 2325683, the transfer mechanism 20 includes a frame 21 associated with or carrying (directly or indirectly) an abutment in the form of a topple bar 46 (FIG. 1). The frame 21 comprises first and second spaced-apart and substantially parallel arms 23 which, in use, are located adjacent road level. The frame 21, and more particularly the length of the arms 23, maintains the topple bar 46 in spaced relation to an in use lower end 48 of the conveyor 18. The topple bar 46 comprises a cross bar that is spaced-apart from the road 16 by an amount that depends on the height of the cones 12 being lifted/laid. Carried by the arms 23 and disposed between the topple bar 46 and the conveyor 18 are a pair of toothed drums 50 capable of being rotated, on a respective shaft 52 that extends between the arms 23, about a substantially horizontal axis, in order to advance a cone 12 onto the conveyor 18, or to deposit a cone 12 from the conveyor 18 onto the road 16. Each drum 50 includes one or more wheels, preferably toothed wheels, each being rotatable about the shaft 52. Two drums 50 are preferred although one drum 50, or more than two drums may alternatively be provided. The drums 50 effectively serve as a conveyor and it will be understood that the drums may be replaced by other conveying means, for example an endless belt type conveyor assembly, or one or more rollers.

As with the apparatus of GB2325683, when the apparatus 10 is advanced towards a cone 12, the topple bar 46 engages with the cone 12 thereby the tilting or toppling the cone 12 as the apparatus 10 is further advanced. The cone 12 is eventually tilted at such an angle that the topple bar 46 passes over the cone 12, following which the cone 12 begins to right itself under the action of gravity. However, at this stage the leading part of the cone 12 is positioned above the drums 50, and therefore drops onto the drums 50 as the cone 12 attempts to right itself.

The transfer mechanism 20 is preferably also provided with a cross bar or support 54 extending substantially horizontally across the frame 21 adjacent the road level (during use) and between the drums 50 and the topple bar 46. During use, the cross bar 54 engages the underside of the cone 12 as the apparatus 10 is advanced thus lifting the cone 12 off the road 16 as it drops onto the drums 50. The drums 50, which may be freely rotatable but which are preferably rotated during use by any suitable drive means or motor, therefore act to propel the cone 12 onto the conveyor 18. Hence the spacing (in the direction of travel of the apparatus 10) between the cross bar 54 and the topple bar 46 is such that the topple bar 46 has disengaged with a tilted cone before the base tilted cone engages with the cross bar 54, and the spacing (in the direction of travel of the apparatus 10) between the cross bar 54 and the drums 50 is such that the cone falls onto the drums 50 as it rights itself under gravity and as it is lifted by the cross bar 54.

The transfer mechanism 20 is advantageously provided with wheels 25, conveniently castor-type wheels, to facilitate the transverse movement of the apparatus 10. Although not shown in FIG. 1, it is preferred to provide a set of one or more wheels at the topple bar end of the transfer mechanism 20 in addition to the wheels 25 shown in FIG. 1.

Once the cone 12 reaches an upper end 68 of the conveyor 18, it is preferably transferred onto a secondary conveyor 70, which may for example be an endless belt type conveyer or a roller type conveyor, and which, in use, projects at least partially over the cone storage area of the vehicle 14. Preferably, the conveyor 70 slopes downwardly from the upper end 68 towards the vehicle 14. The conveyor 70 may be carried by the vehicle itself (in which case it does not necessarily need to be connected to the apparatus 10), or may be an integral part of the apparatus 10 (in which case it may or may not be supported by the vehicle 14).

Figure 8:
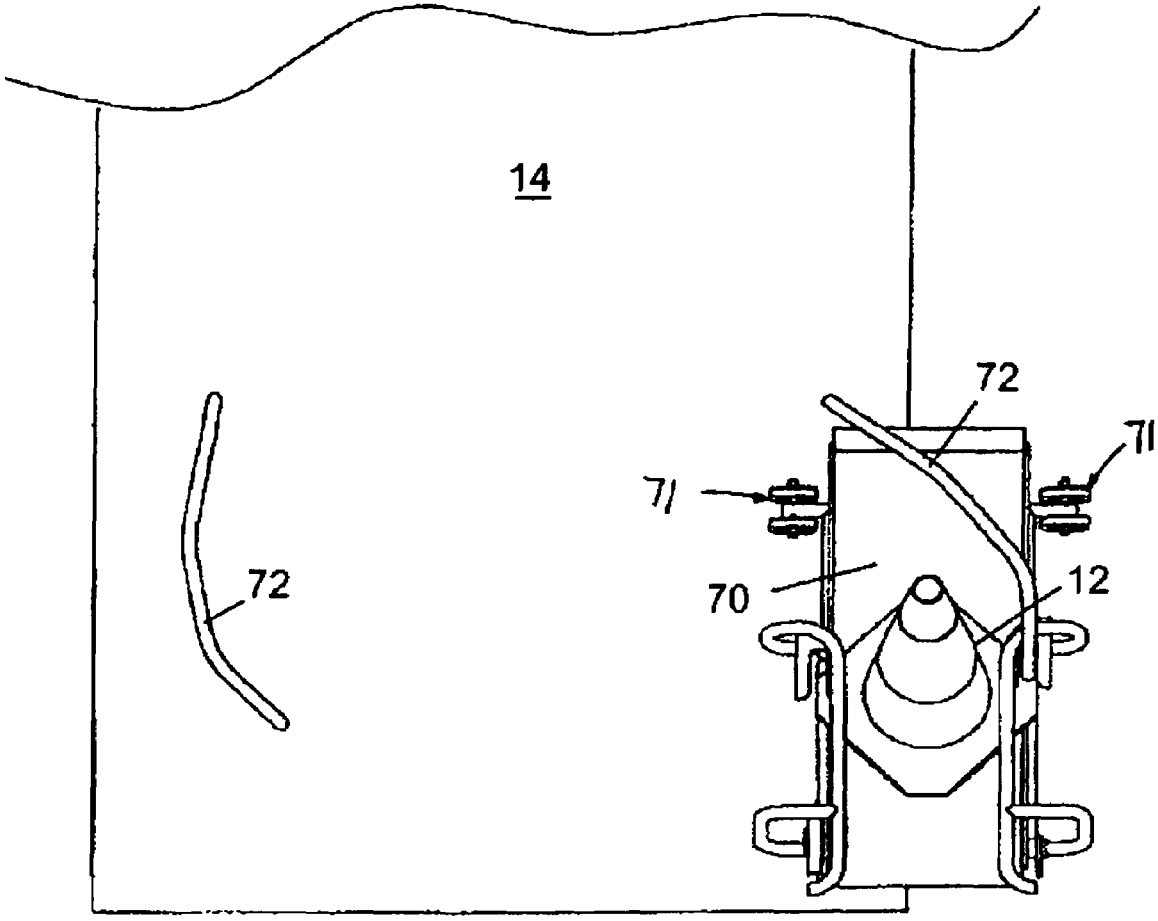
FIG. 8 illustrates a plan view of a secondary conveyor, forming part of the apparatus of FIG. 1.

Referring in particular to FIG. 8, the secondary conveyor 70 is preferably associated with a guide rail 72 arranged to direct cones 12 from the conveyor 70 onto the vehicle 14. The guide rail 72 is particularly advantageous when used to ensure that the cones 12 are deposited onto the vehicle 14 when the conveyor 18 is laterally displaced beyond the side of the vehicle 14. Preferably, the guide, or side, rail 72 is pivotable (about an in use vertical axis) so that its orientation may be adjusted to suit the lateral position of the conveyor 70. The guide rail 72 may be mounted on the conveyor 70 or on the vehicle 14. Preferably, a respective guide rail 72 is provided for each side of the vehicle 14. For example, FIG. 8 shows a left hand side guide rail 72 mounted to the vehicle 14 and a right hand side guide rail 72 mounted on the conveyor 70. Advantageously, the guide rail or each guide rail 72 is capable of pivoting in order to track the lateral position of the secondary conveyor 70. To this end, the pivoting of the guide rail(s) 72 may be mechanically, or electro-mechanically, linked to the movement of the conveyor 70. The guide rails 72 are capable of guiding cones 12 off the secondary conveyor 70 onto the rear of the vehicle 14 in a direction that is oblique with respect to the direction in which cones move along the conveyor 70. In order to allow the secondary conveyor 70 to remained fixed in position relative to the conveyor 18, the secondary conveyor 70 is preferably mounted on, or connected to, the carriage 28. Advantageously, the conveyor 70 is provided with wheels 71 which, during use, engage with the storage surface of vehicle 14, support the conveyor 70 on the vehicle 14 and facilitate lateral movement of the conveyor 70 with respect to the vehicle.

Unlike the apparatus of GB 2325683, the transfer means 20 of the present invention is provided with, or associated with, a set of guide members or rails 56. A respective guide rail 56 is provided at each side of the frame 21 such that a channel is defined between the guide rails 56 along which cones 12 travel on their way to the loading end 48 of the conveyor 18. Each guide rail 56 may be carried by a respective support bar 57 which is in effect an extension of the respective arm 23 and which therefore may be integral with, or connected to, the respective arm 23. The topple bar 46 is conveniently carried by the support bars 57. It is preferred however, that the topple bar 46 is spaced from the free ends 59 of the support bars 57 (in a direction towards the conveyor 18) such that the guide rails 56 extend beyond the topple bar 46 with respect to the conveyor 18. This enables the guide rails 56 to perform some alignment of cones 12 before the cones 12 are contacted by the topple bar 46.

The guide rails 56 are shaped such that the channel defined thereby is relatively wide at its mouth 61, i.e. at the free ends 59 of the support bars 57, and narrows in a direction towards the conveyor 18. Hence, the channel is tapered, or funnel-like, and serves to align cones 12 with the conveyor 18. The guide rails 56 may thus be used to funnel cones 12, which may be off center with respect to the conveyor 18, centrally towards the conveyor 18, thereby allowing cones 12 to be collected without requiring the excessive steering of the vehicle 14, or lateral displacement of the conveyor 18 by means of the slideway 22.

The lateral spacing between the guide rails 56 is such that the body or sidewall 58 of a cone 12 may pass along the channel to the conveyor 18. However, the spacing between guide rails 56 is further arranged such that the base 60 of a cone 12 is prevented from passing therebetween at least in a region between the topple bar 46 and the drums 50. More particularly, the relatively narrow region of the channel is arranged such that, when a cone 12 is tilted by the topple bar 46, the base 60 of the cone 12 is prevented from passing between the guide rails 56.

In addition to tapering inwardly towards the conveyor 18, each guide rail 56 extends, in use, away from the surface of the road 16 as it progresses from the mouth 61 towards the conveyor 18. The arrangement is such that, at least in the region between the topple bar 46 and the drums 50, the guide rails 56 are spaced apart from the road surface 16 to allow limited tilting of the base 60 of the cone 12 when the cone 12 is engaged by the topple bar 46, while preventing the cone 12 from being tilted to the extent that it topples over by engagement with the base 60. The preferred vertical profile of the guide rails 56 is such that as the cone 12 is toppled, the guide rails 56 generally follow the path of the base 60 as it is raised off the road 16 by the toppling action of the cone 12.

In use, a crossbar 62 of the topple bar 46 contacts the sidewall 58 of the cone 12 as the apparatus 10 is advanced towards the cone 12. The cone 12 thus begins to tilt, raising the base 60 towards, or into light contact with, the guide rails 56. As the apparatus 10 is advanced further, increasing the angle of tilt of the cone 12, the base 60 is raised further (hence the increase in height of the guide rails 56 as they approach the drums 50 to allow the cone 12 to be titled). As the apparatus 10 is further advanced, the cross bar 62 passes over the top of the cone 12, following which the cone 12 will begin to right itself, resulting in the base 60 landing on the rotating drums 50, which propel the cone 12 onto the conveyor 18. As the cone 12 is righting, the apparatus 10 is still advancing, resulting in the support bar or cross bar 54 hitting the edge of the base 60 still on the road 16. This impact raises the base 60 completely off the road 16, ensuring that the cone 12 lands cleanly on the drums 50 of the transfer means 20. The topple bar 46 and the support bar 54 are preferably spaced from one another such that the support 54 contacts the base 60 when the cone 12 is at an angle of between approximately 30 degrees and 45 degrees to the vertical. The support 54 is also preferably raised off the road 16 by a distance of approximately up to 100 mm, depending on the actual dimensions of the cone 12.

Hence, the guide rails 56 are carefully contoured to allow the base 60 to be tilted off the road 16, while preventing the cone 12 from tilting beyond an angle of inclination which would result in the cone 12 toppling completely onto the road 16, which would prevent the cone 12 from being passed onto the conveyor 18. The guide rails 56 therefore allow for an increased speed of collection of the cones 12, as the topple bar 46 can strike the cone 12 at almost any speed without the impact resulting in the cone 12 toppling over, as the guide rails 56 will contact and restrain the base 60.

If the apparatus 10 is to be utilized for collecting a cone 12 with any form of appendage, e.g. a lamp, secured to the top of the cone 12, the topple bar 46 would not be able to pass cleanly over the top of the cone 12. This could result in a cone 12 jamming in the transfer means 20, or resulting in the topple bar 46 knocking the appendage off the top of the cone 12.

Figure 4:
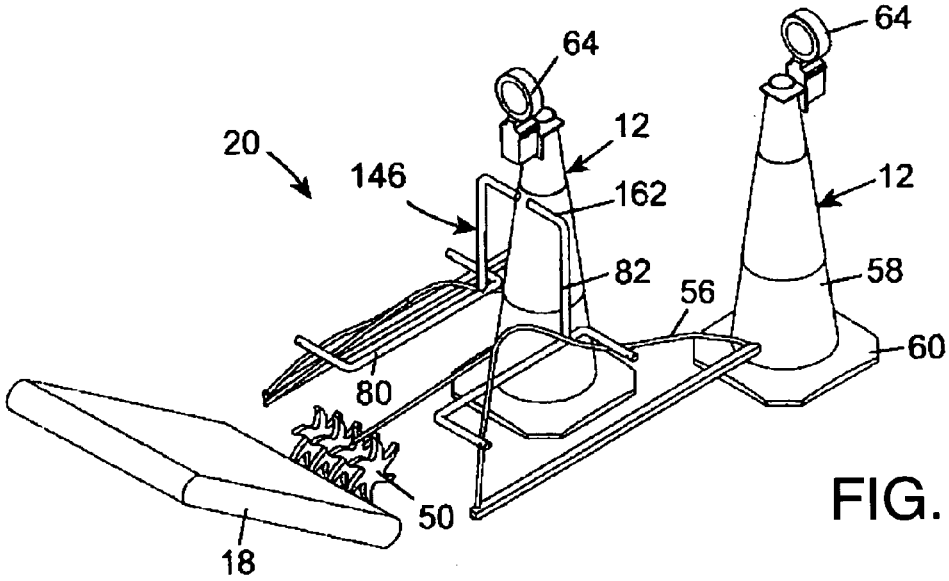
FIG. 4 illustrates an alternative topple bar assembly forming part of the apparatus of FIG. 1, the apparatus being shown approaching a traffic cone having a beacon thereon.
Figure 5:
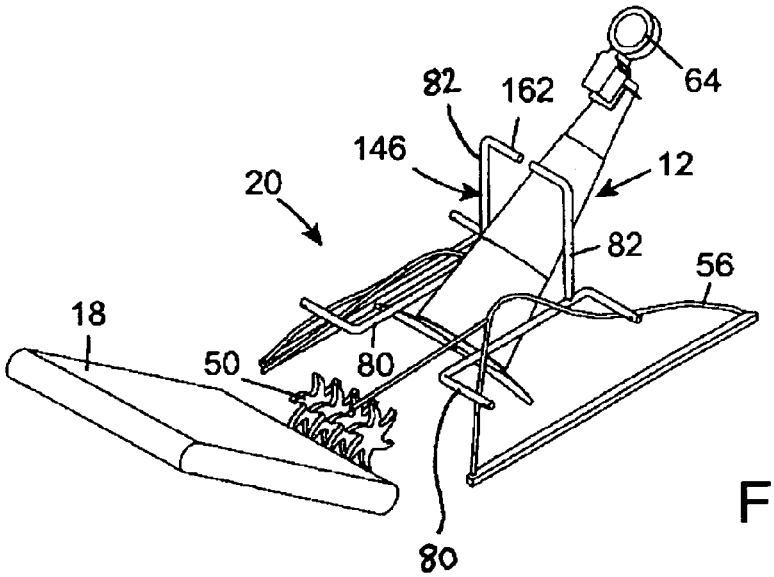
FIG. 5 illustrates the arrangement of FIG. 4, in which the topple bar has contacted, and begun to topple, the traffic cone.
Figure 6:
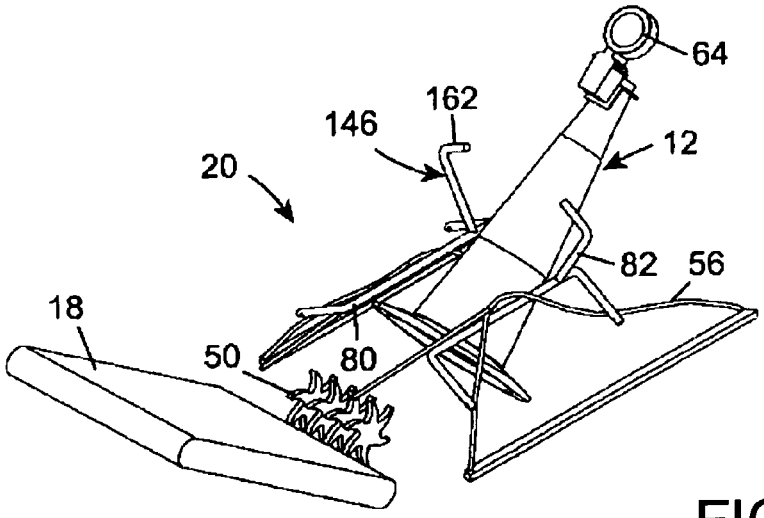
FIG. 6 illustrates the arrangement of FIG. 4, in which the topple bar has been pivoted out of contact with the traffic cone.

Referring to FIGS. 4 to 6, the apparatus 10, and in particular the transfer mechanism 20, may be provided with an alternative topple bar assembly, generally indicated as 146, for particular use with cones 12 having an appendage such as a lamp or beacon 64 secured to the top thereof. The topple bar assembly 146 includes of a pair of contact members in the form of pivot bars 80, each of which is pivotable with respect to the transfer mechanism 20 about an, in use, substantially horizontal axis. Extending from each pivot bar 80 is an upright 82 from which extends a crossbar 162. The arrangement is such that, in a rest state, the respective cross bars 162 extend laterally, or transversely, across the transfer mechanism 20 at a height above the road 16 so as to be able to engage with a cone in order to topple the cone, the free ends of the cross bars 162 being sufficiently close to each other to engage with a cone 12. In the rest state, the pivot bars 80 may be substantially horizontally disposed and the uprights 82 may be substantially vertically disposed, as illustrated in FIGS. 4 and 5. In a pivoted state (as shown in FIG. 6), the pivot bars 80 are pivoted about their respective axis thereby causing the cross bars 162 to move away from one another, or open, to allow the passage of a cone 12 therebetween.

In use, as the transfer mechanism 20 advances towards a cone 12, the pair of crossbars 162 contact the side wall 58 of the cone 12, resulting in tilting of the cone 12. However, as the base 60 of the cone 12 rises, following the contours of the guide rails 56, the base 60 (or some other part of the cone 12) comes into contact with the pivot bars 80, as illustrated in FIG. 5.

Referring then to FIG. 6, as the cone 12 continues to tilt, and the base 60 thereof continues to raise, it causes the pivot bars 80 to pivot upwardly, thereby resulting in the crossbars 162 opening outwardly away from one another. This action allows the cone 12, and in particular the beacon 64 mounted thereon, to pass between the opposed portions of the topple bar assembly 146, to be deposited onto the drums 50, and subsequently the conveyor 18, as hereinbefore described.

Preferably, the center of gravity of the two opposing portions of the topple bar assembly 146 is arranged such that they adopt the rest state after a cone 12 has passed through. It will be understood that the topple bar assembly 146 need not necessarily include opposing portions on either side of the transfer mechanism 146—a single pivoting assembly 80, 82, 162 on one side of the transfer mechanism 30 may alternatively be provided.

The topple bar assembly 146 allows cones 12 with appendages such as the beacon 64 or the like to be collected using the apparatus 10. Using the topple bar assembly 146, cones (not shown) of different heights can also be accommodated, in addition to double or multi-stacked cones (not shown). The topple bar assembly 146 could be used with prior art cone collecting devices (not shown), such as that disclosed in the applicant's earlier UK Pat. No. GB 2325683, as could the guide rails 56. In preferred embodiments, the height of the cross bar 162 above the road 16 is such that it engages during use with cones 12 at a level approximately two thirds of the height of the cone 12.

Referring now to FIGS. 9 to 12, there is shown, generally indicated as 246, a further alternative topple bar assembly, which may be used with the apparatus 10, or with the apparatus of GB 2325683. In FIGS. 9 to 12, the whole transfer mechanism 20 is not shown—only those parts are shown that allow the location and operation of the topple bar assembly 246 to be understood. Moreover, those parts of the transfer mechanism 20 and apparatus 10 that are shown are not necessarily shown fully in FIGS. 9 to 12 since this is not necessary for an understanding of the topple bar assembly 246.

Figure 9:
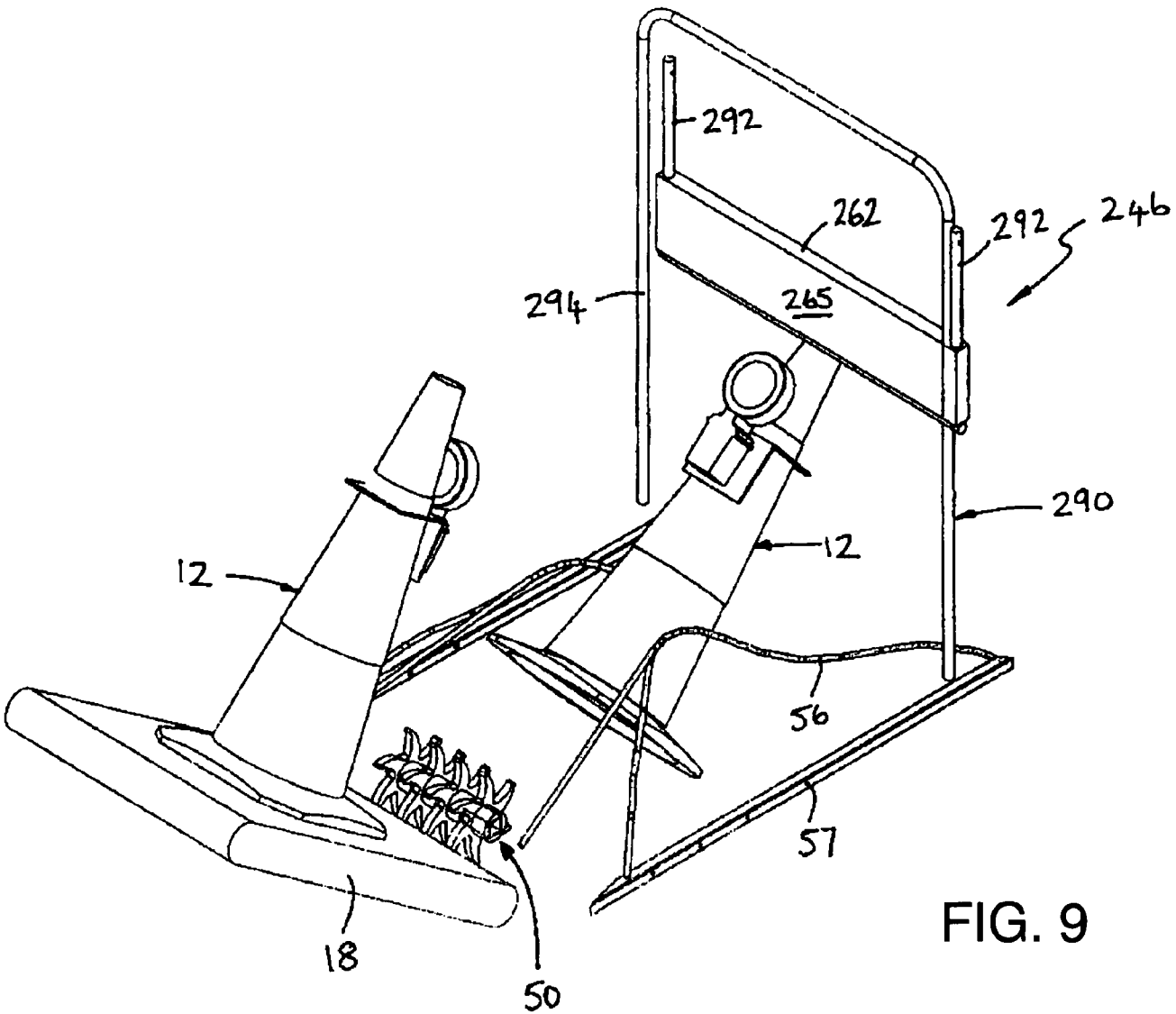
FIG. 9 is a perspective view of a further alternative topple bar assembly in a collecting mode of operation.
Figure 10:
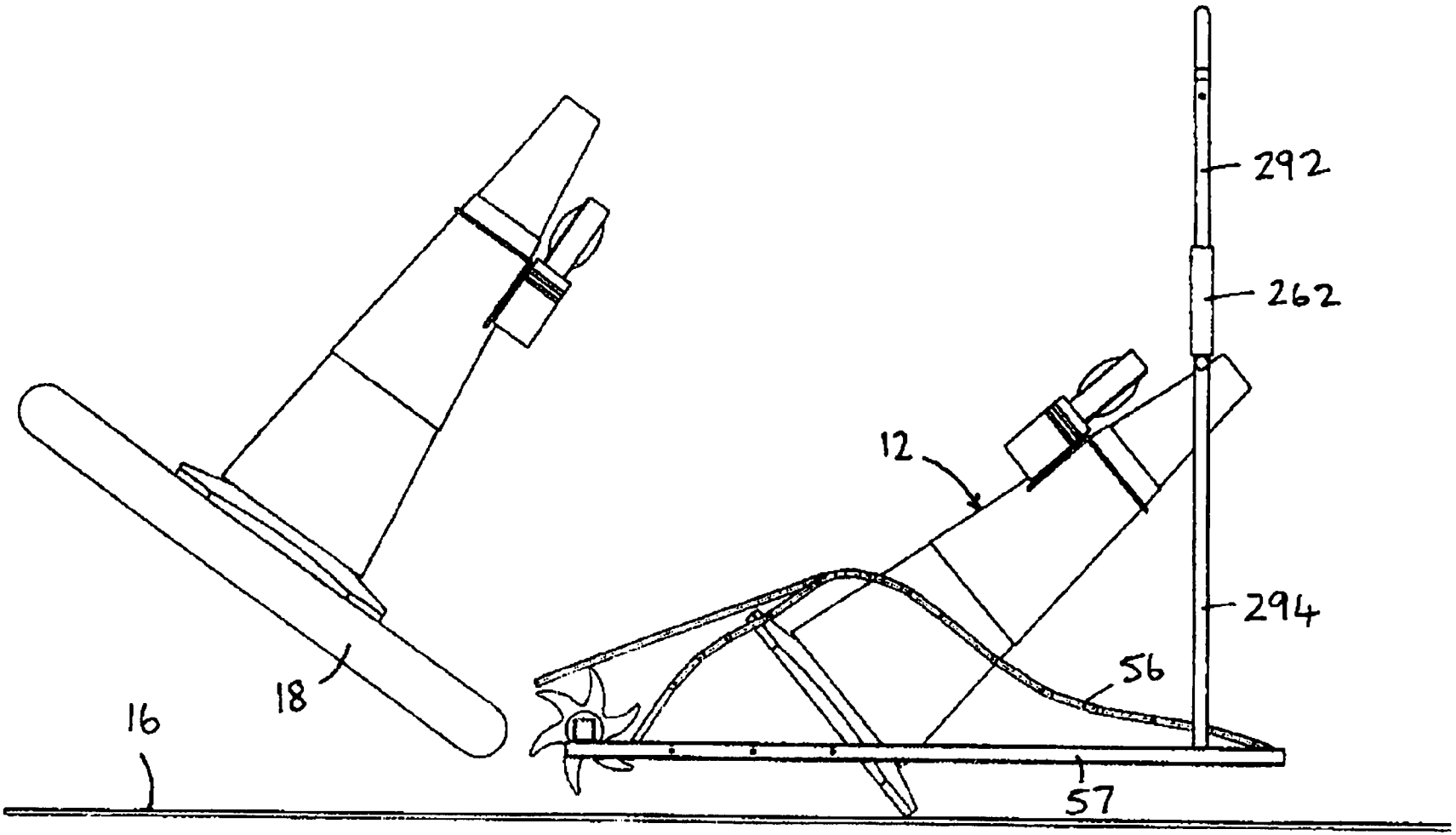
FIG. 10 is a side view of the illustration of FIG. 9.
Figure 11:
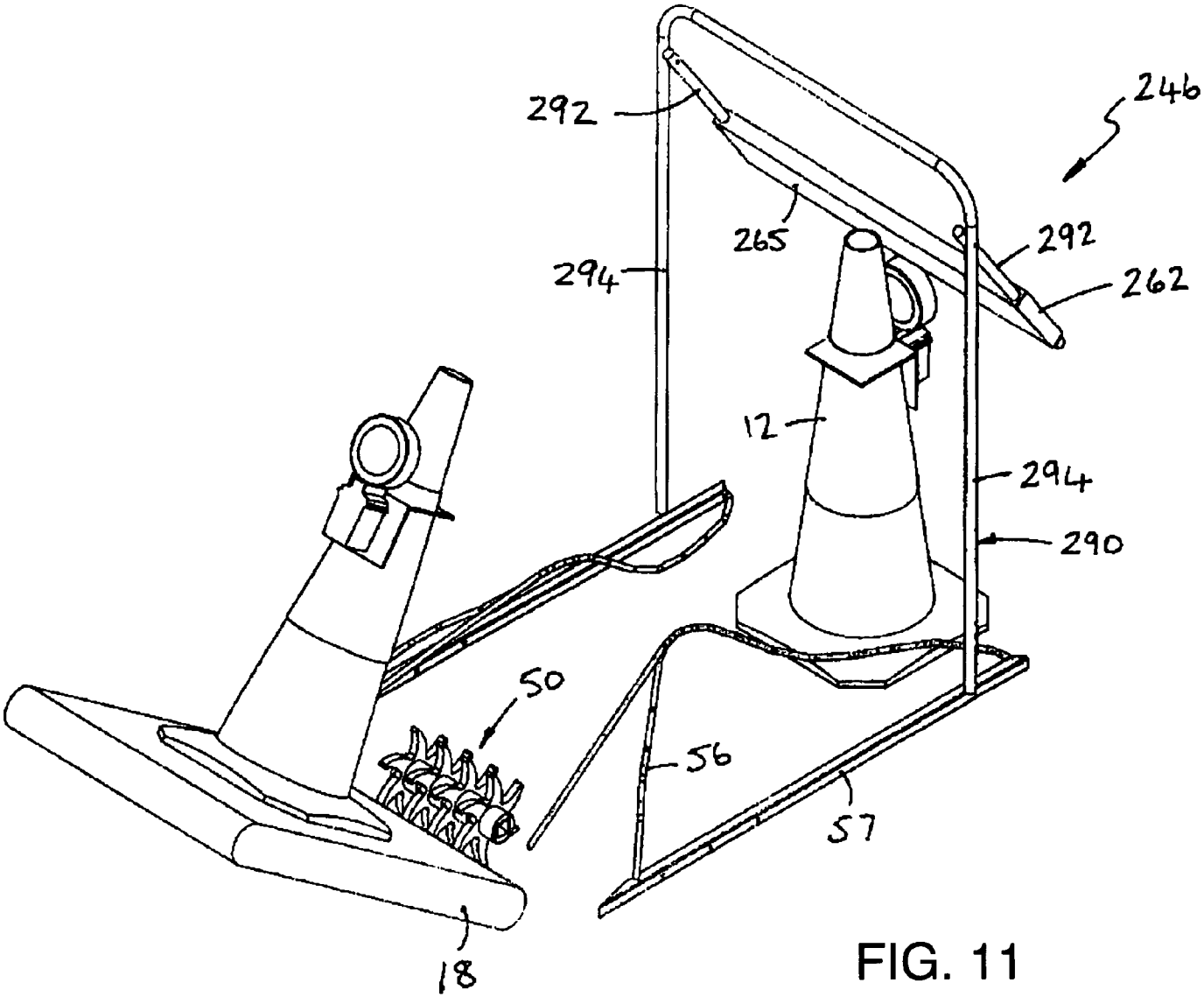
FIG. 11 is a perspective view of the topple bar assembly of FIG. 9 in a dispensing mode of operation.
Figure 12:
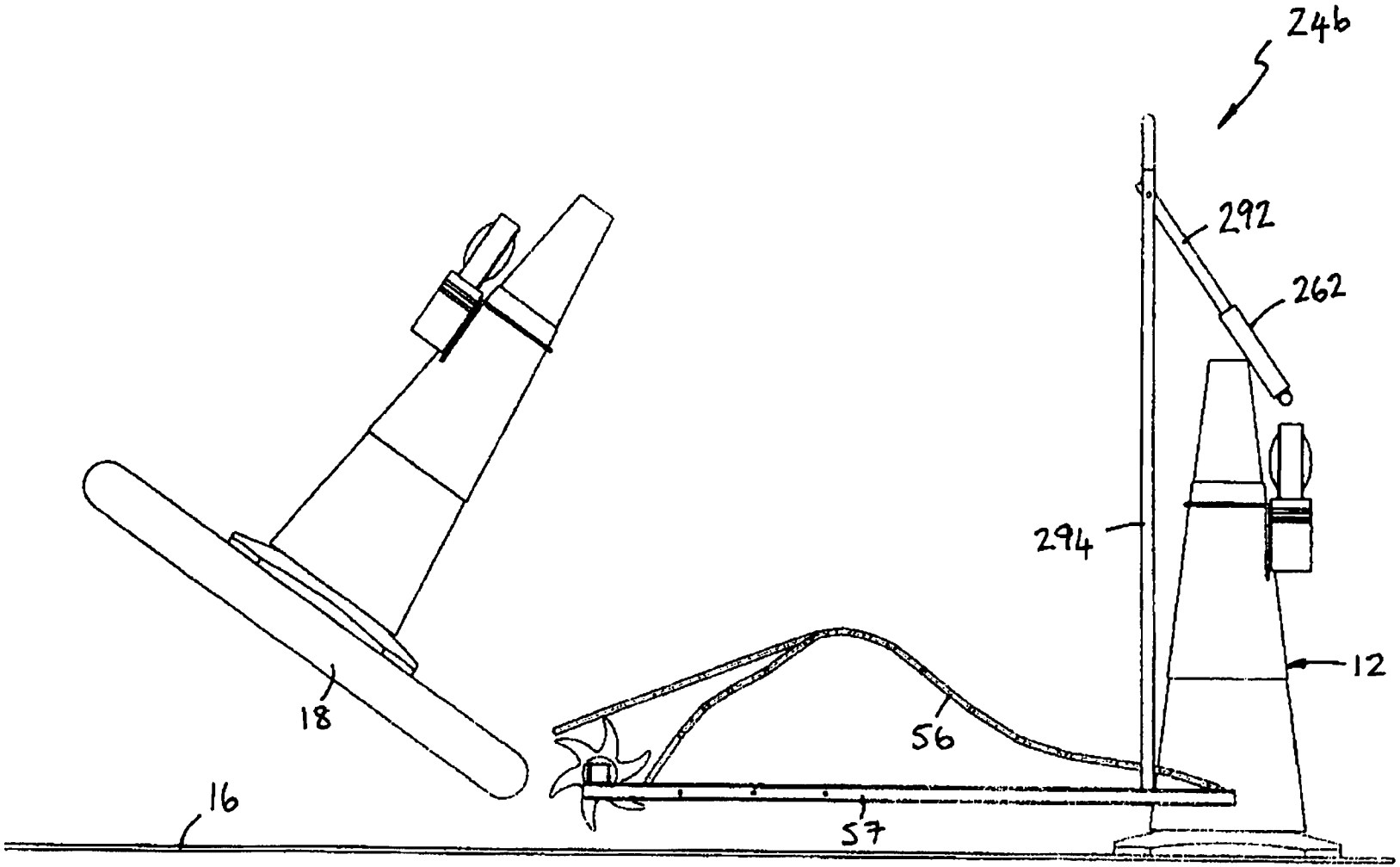
FIG. 12 is a side view of the illustration of FIG. 11.

The topple bar assembly 246 includes a support frame 290 which carries a toppling member, or cross piece 262 for engaging with cones 12 during use. The cross piece 262 is movable with respect to the support frame 290 in a direction away from the conveyor 18 from a rest state (as shown in FIGS. 9 and 10) to a displaced state (as shown in FIGS. 11 and 12). Preferably, the cross piece 262 is pivotable with respect to the support frame 290 such that it may swing in a direction away from the conveyor 18. In the illustrated embodiment, this is achieved by connecting the cross piece 262 to the support frame 290 by arms 292, each arm being pivotably connected to the support frame 290. The preferred arrangement is such that the crosspiece 262 adopts the rest state under the influence of gravity. It is preferred that the cross piece 262 is not able to swing towards the conveyor 18 beyond the rest state. To this end, a stop member (not shown) may be provided on the cross piece 262 which engages with the support frame 290 during use to prevent the cross piece 262 from moving towards the conveyor 18 beyond the rest state.

The support frame 290 is mountable on the apparatus 10 (or similar apparatus) at or adjacent the transfer mechanism 20 and may conveniently be carried by the arms 23 or support bars 57. When so mounted, the cross piece 262 extends (at least in the rest state) laterally across the transfer mechanism 20 in a manner similar to the cross bars 62, 162. In the illustrated embodiment, the support frame 290 comprises two posts 294 between which the cross piece 262 is pivotably mounted, each post being mounted on, or mountable on, a respective support bar 57.

It is preferred that the cross piece 262 has a flat surface 265 for engaging with the cone 12 (or an attachment mounted on the cone 12) when in a dispensing mode. The flat surface 265 is dimensioned such that it will have a sliding contact with a cone 12 (or attachment) during the dispensing operation. This facilitates the passage of the cone 12 past the cross piece 262 and minimizes the risk that the cross piece 262 will catch on the cone 12 (or attachment). Conveniently, therefore, the cross piece 262 may take the form of a generally flat or planar member.

In the rest state, the cross piece 262 extends between the posts 294 at a height above the road surface 16 at which it will engage with cones 12 and/or their attachments. In use, when lifting cones 12 (as shown in FIGS. 9 and 10) the cross piece 262 engages with and tilts cones 12 in a manner substantially similar to that described for previous embodiments. During this operation, the cross piece 262 remains in the rest state since it is prevented from moving towards the conveyor 18.

When dispensing cones 12 (as illustrated in FIGS. 11 and 12), each cone 12 (or an attachment thereon) engages with the cross piece 262 and causes it to move, or swing, away from the conveyor 18 towards the displaced state. Hence, the cross piece 262 effects little or no tilting of the cones 12. As a result, the cones 12 are dispensed in a more consistent manner since, if the cones 12 are tilted significantly during the laying operation, they can rock or swivel as they settle themselves and this can cause them to come to rest in a location other than that which was intended.

Preferably, the height at which the cross piece 262 is located with respect to the road surface 16 is adjustable to accommodate cones 12 of different sizes, or with different attachments. This can be achieved in any convenient manner, for example by providing a plurality of locations at which the arms 292 may be connected to the posts 294. It is also preferred that the distance between the cross piece 262 and the conveyor 18 is adjustable (e.g. by being able to mount the support frame 290 at various locations along the length of the arms 23 or support bars 57) to accommodate cones of different sizes or with different attachments. These adjustments are preferably also provided for in the apparatus 10.

It will be apparent that the topple bar assembly 246 may be present on the apparatus 10, or similar apparatus, during both the lifting and laying modes of operation.

The present invention is not limited to the embodiments described herein, which may be amended or modified without departing from the scope of the present invention.

The invention claimed is:

1. An apparatus for collecting traffic cones from a surface to a vehicle, or dispensing traffic cones onto the surface from the vehicle, the apparatus comprising:

a conveyor disposed in use between the vehicle and the surface for transferring traffic cones therebetween, and means for actuating the conveyor in a transverse direction substantially perpendicular with the direction of movement of the vehicle during use;

wherein the conveyor actuating means comprises a sliding mechanism for effecting relative sliding movement between the conveyor and the vehicle in said transverse direction, the sliding mechanism comprising: a base section mountable on the vehicle; a sliding section slidably coupled to the base section for sliding movement in said transverse direction; and means for effecting relative sliding movement between the base section and the sliding section; and a carriage by which the conveyor is coupled to the sliding section, the carriage being slidable with respect to the sliding section in said transverse direction, and wherein said carriage is extendible beyond one or both ends of the base section in said transverse direction such that said conveyor is positionable beyond one or both ends of the base section in said transverse direction; and wherein said apparatus further includes a transfer mechanism for transferring traffic cones from the surface to the conveyor, the transfer mechanism including a toppling device arranged to engage with and tilt the traffic cone as the apparatus is advanced towards the traffic cone, and to release the traffic cone as the apparatus is further advanced towards the traffic cone such that the traffic cone returns to an upright position under the action of gravity, and wherein the toppling device includes at least one contact member connected to or including at least one toppling member, the at least one contact member being movable between a rest state, in which the at least one toppling member is positioned to engage with and tilt the traffic cone, and a displaced state in which the at least one toppling member is displaced from said engage and tilt position, the arrangement being such that, when the at least one toppling member engages with and tilts the traffic cone, the tilted traffic cone engages with the at least one contact member and moves the contact member from the rest state to the displaced state.

2. The apparatus of claim 1, wherein the sliding section is telescopically coupled to the base section such that at least a portion of the sliding section is extendible beyond one or both ends of the base section in said transverse direction.

3. The apparatus of claim 1, wherein the carriage is coupled to the sliding section such that sliding movement of the sliding section causes a corresponding sliding movement of the carriage in the same direction.

4. The apparatus of claim 1, further including means for controlling the speed at which the conveyor actuating means actuates the conveyor, the controlling means being arranged to set the actuation speed of the conveyor depending on the speed of the vehicle.

5. The apparatus of claim 1, the apparatus being mounted on the rear of said vehicle.

6. The apparatus of claim 5, wherein the apparatus is arranged such that the longitudinal axis of the conveyor is substantially parallel with the longitudinal axis of the vehicle.

7. The apparatus of claim 1, wherein the at least one contact member is pivotable with respect to the transfer mechanism.

8. The apparatus of claim 1, wherein the at least one contact member is positioned in the rest state for engagement with the base of a tilted cone.

9. The apparatus of claim 1, wherein two contact members are provided, each associated with a respective toppling member and being located on opposing sides of the transfer mechanism.

10. The apparatus of claim 1, wherein the toppling device includes at least one stop member for preventing the toppling member from being moved towards the conveyor with respect to the rest state.

11. The apparatus of claim 1, wherein the toppling device includes a support frame carried by the transfer mechanism, the toppling member being pivotably mounted on the support frame for swinging movement between the rest and displaced states.

12. The apparatus of claim 1, wherein the transfer mechanism includes, or is associated with, means for guiding a cone to the conveyor as the apparatus advances towards the cone, the guide means defining a channel having a relatively wide mouth distal the conveyor and becoming narrower in a direction towards the conveyor.

13. The apparatus of claim 12, wherein the channel includes a relatively narrow portion between the mouth and the conveyor which is substantially aligned with the center of the conveyor.

14. The apparatus of claim 12, wherein, in a portion of the channel, the guide means is arranged to engage with a tilted cone in order to limit the extent to which the cone can tilt.

15. The apparatus of claim 12, wherein the guide means comprises a respective guide member or rail located at either side of the transfer mechanism and being shaped and dimensioned to define said channel.

16. The apparatus of claim 12, wherein the toppling device is located between the mouth of the channel and the conveyor.

17. The apparatus of claim 12, wherein the guide means is located adjacent the surface at the mouth of the channel and rises in a direction towards the conveyor.

18. The apparatus of claim 1, wherein at least one of said sliding section and said carriage is telescopically slidable with respect to the base section such that at least a portion of said at least one sliding section and said carriage is extendible beyond one or both ends of the base section in said transverse direction.

19. The apparatus of claim 1, wherein the carriage is slidable substantially along the entire length of the sliding section in said transverse direction.

20. The apparatus of claim 1, wherein the carriage is telescopically coupled to the sliding section such that at least a portion of the carriage is extendible beyond one or both ends of the sliding section in said transverse direction.

21. The apparatus of claim 1, wherein the carriage is coupled to the base section and the sliding section by means of a belt device comprising at least one length of flexible, substantially inelastic line, the at least one line being fixed to the carriage and to the base section and being in sliding or rolling contact with said sliding section.

22. The apparatus of claim 1, wherein said means for effecting relative sliding movement between the base section and the sliding section comprises a lead screw provided on the base section and lead screw follower coupled to the sliding section.

* * * * *